US010867478B2

(12) United States Patent
Hendricks et al.

(10) Patent No.: US 10,867,478 B2
(45) Date of Patent: Dec. 15, 2020

(54) SYSTEMS AND METHODS FOR PLAYING AN ELECTRONIC GAME INCLUDING A PATH BASED BONUS GAME

(71) Applicant: Aristocrat Technologies Australia Pty Limited, North Ryde (AU)

(72) Inventors: Bradley John Hendricks, Las Vegas, NV (US); Lorin Santucci, Las Vegas, NV (US); Thomas Tuomey, Las Vegas, NV (US); Aiden Chonghoon Kim, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 15/605,447

(22) Filed: May 25, 2017

(65) Prior Publication Data

US 2018/0293847 A1 Oct. 11, 2018

Related U.S. Application Data

(60) Provisional application No. 62/483,746, filed on Apr. 10, 2017.

(51) Int. Cl.
*G07F 17/32* (2006.01)

(52) U.S. Cl.
CPC ..... *G07F 17/3267* (2013.01); *G07F 17/3213* (2013.01); *G07F 17/3246* (2013.01); *G07F 17/3251* (2013.01); *G07F 17/3288* (2013.01)

(58) Field of Classification Search
CPC ..... A63F 13/00; A63F 9/24; G07F 17/3267; G07F 17/3213; G07F 17/3246; G07F 17/3251; G07F 17/3288
See application file for complete search history.

(56) References Cited

U.S. PATENT DOCUMENTS 3,191,184 A * 6/1965 Durstewitz ..... A63F 3/00006 273/249
5,108,111 A * 4/1992 Bilodeau ..... A63F 3/00097 273/249

(Continued)

FOREIGN PATENT DOCUMENTS

GB 2353128 * 1/2000

OTHER PUBLICATIONS

General information for the Candy Land board game retrieved on Jul. 20, 2018 from website https://en.wikipedia.org/wiki/Candy_Land.

(Continued)

*Primary Examiner* — Malina D. Blaise
(74) *Attorney, Agent, or Firm* — Armstrong Teasdale LLP

(57) ABSTRACT

Systems, methods, and articles of manufacture for electronic gaming are disclosed. In a first aspect, the method is implemented on an electronic gaming system and includes initiating, by a game controller and in response to a primary game outcome of a wagering game, a bonus game. The method also includes displaying, by the game controller and in response to the initiating, a path, where the path includes a plurality of locations, and displaying, by the game controller, a wheel, where the wheel includes a plurality of stop positions. The method includes, in addition, selecting, by the game controller, a first stop position of the plurality of stop positions of the wheel, and advancing, by the game controller, an animated character on the path by a first number of locations corresponding to the first stop position.

25 Claims, 8 Drawing Sheets

(56) References Cited

U.S. PATENT DOCUMENTS 6,572,472 B1* 6/2003 Glavich ..... G07F 17/32 463/16
6,743,096 B2* 6/2004 Allendorf ..... G07F 17/32 273/138.1
6,988,947 B2 1/2006 Baerlocher et al.
6,991,539 B2 1/2006 Pacey
7,195,560 B2 3/2007 DeMar et al.
7,452,271 B2 11/2008 DeMar et al.
7,976,373 B2 7/2011 Kroeckel et al.
8,231,454 B2 7/2012 Caputo
8,690,658 B2 4/2014 Pacey et al.
8,721,422 B2 5/2014 Casey et al.
8,734,234 B1 5/2014 Guase et al.
8,747,205 B2 6/2014 Englman
9,070,254 B2 6/2015 Aoki et al.
9,311,786 B2 4/2016 Ryan
9,320,967 B2 4/2016 Knutsson
9,472,047 B2 10/2016 Hilbert et al.
9,547,956 B1 1/2017 Polyakov et al.
2002/0016200 A1* 2/2002 Baerlocher ..... G07F 17/3244 463/20
2002/0160827 A1 10/2002 Slomiany et al.
2003/0064787 A1* 4/2003 Weiss ..... G07F 17/32 463/20
2003/0199309 A1* 10/2003 DeMar ..... G07F 17/32 463/20
2004/0048662 A1* 3/2004 Ulmer ..... G07F 17/3244 463/30
2005/0137004 A1 6/2005 Wood et al.
2005/0261055 A1* 11/2005 Casey ..... G07F 17/32 463/20
2007/0021183 A1 1/2007 Fiden et al.
2007/0228660 A1* 10/2007 Thompson ..... A63F 3/00006 273/430
2007/0259706 A1* 11/2007 Anderson ..... G07F 17/3239 463/16
2008/0194320 A1 8/2008 Walsh et al.
2009/0014956 A1 1/2009 Sutor, Jr.
2010/0029381 A1* 2/2010 Vancura ..... G07F 17/3244 463/30
2013/0005426 A1* 1/2013 Nicely ..... G07F 17/32 463/20
2015/0328535 A1* 11/2015 Lorenzen ..... A63F 3/00006 273/243
2016/0220898 A1 8/2016 Nyblom et al.
2016/0354679 A1 12/2016 Shi et al.

OTHER PUBLICATIONS

Australian Examination Report for AU2019253854, dated Sep. 4, 2020, 4 pages.

* cited by examiner

SYSTEMS AND METHODS FOR PLAYING AN ELECTRONIC GAME INCLUDING A PATH BASED BONUS GAME

CROSS REFERENCE TO RELATED APPLICATIONS

This application claims the benefit of U.S. Provisional Patent Application No. 62/483,746, filed Apr. 10, 2017, which is hereby incorporated by reference in its entirety.

BACKGROUND

The subject matter of the present disclosure relates to electronic gaming, and more particularly to methods of playing an electronic game including a path based bonus game.

At least some gaming machines are configured to present a bonus game in response to the occurrence of a bonus condition or bonus trigger in a base, or primary, game. Specifically, a player may qualify for a bonus game based upon one or more base game outcomes. A bonus game may be played in accordance with rules that are different from the rules of the base game, and prizes or awards generated during the bonus game may be different from prizes and awards generated during the base game.

As the number and variety of available gaming systems increases, gaming systems operators, such as casinos, continue to strive for the design and implementation of new and exciting gaming systems. The present disclosure is therefore directed to such gaming systems. In particular, the present invention is directed to gaming systems and methods including a path based bonus game.

BRIEF DESCRIPTION

Systems, methods, and articles of manufacture for electronic gaming are disclosed. In a first aspect, a method of electronic gaming using a gaming system is provided. The gaming system includes a display configured to display a wagering game, a player input interface, a credit input mechanism including at least one of a card reader, a ticket reader, a bill acceptor, and a coin input mechanism, the credit input mechanism configured to establish a credit balance that is increasable and decreasable based on wagering activity, a tangible, non-transitory, computer-readable memory, and a game controller communicatively coupled to the memory.

The method includes initiating, by a game controller and in response to a primary game outcome of a wagering game, a bonus game. The method also includes displaying, by the game controller and in response to the initiating, a path, where the path includes a plurality of locations, and displaying, by the game controller, a wheel, where the wheel includes a plurality of stop positions. The method includes, in addition, selecting, by the game controller, a first stop position of the plurality of stop positions of the wheel, and advancing, by the game controller, an animated character on the path by a first number of locations corresponding to the first stop position.

In another aspect, an electronic gaming system is provided. The electronic gaming system includes a display configured to display a wagering game, a player input interface configured to receive a player input, a credit input mechanism including at least one of a card reader, a ticket reader, a bill acceptor, and a coin input mechanism, the credit input mechanism configured to receive a credit wager, the credit wager initiating play of the wagering game, a game controller for controlling the wagering game, and a tangible, non-transitory, computer-readable storage medium having instructions stored thereon.

The game controller executes the instructions stored on the storage medium to perform operations including initiating, by a game controller and in response to a primary game outcome of a wagering game, a bonus game. The game controller also performs operations including displaying, by the game controller and in response to the initiating, a path, where the path includes a plurality of locations, and displaying, by the game controller, a wheel, where the wheel includes a plurality of stop positions. The game controller performs, in addition, operations including selecting, by the game controller, a first stop position of the plurality of stop positions of the wheel, and advancing, by the game controller, an animated character on the path by a first number of locations corresponding to the first stop position.

In yet another aspect, an article of manufacture including a non-transitory, tangible, computer readable storage medium having instructions stored thereon that, in response to execution by a game controller configured for electronic gaming, cause the game controller to perform operations including initiating, by a game controller and in response to a primary game outcome of a wagering game, a bonus game. The game controller also performs operations including displaying, by the game controller and in response to the initiating, a path, where the path includes a plurality of locations, and displaying, by the game controller, a wheel, where the wheel includes a plurality of stop positions. The game controller performs, in addition, operations including selecting, by the game controller, a first stop position of the plurality of stop positions of the wheel, and advancing, by the game controller, an animated character on the path by a first number of locations corresponding to the first stop position.

BRIEF DESCRIPTION OF THE DRAWINGS

An exemplary embodiment of the subject matter disclosed will now be described with reference to the accompanying drawings.

DETAILED DESCRIPTION

Exemplary embodiments of the present disclosure relate to systems, methods, and articles of manufacture for an electronic game, such as, for example, an electronic bonus game provided as a result of a base game outcome. A game or bonus game is facilitated in which a plurality of symbol display positions are selected, evaluated, merged, and/or unmerged to generate an optimal and/or maximum game outcome and/or game award. Selected symbol display positions may be merged with and/or unmerged from other, adjacent, selected symbol display positions during gameplay, to facilitate an optimal and/or maximum game award being represented or displayed during gameplay.

The present disclosure may be implemented in various configurations for gaming machines, including but not limited to: (1) a gaming machine in which the computerized instructions for controlling one or more games are stored within the gaming machine prior to delivery to a gaming establishment; and/or (2) a changeable gaming machine in which the computerized instructions for controlling one or more games are subsequently downloaded to the gaming machine through a data network after the gaming machine is installed within in a gaming establishment.

In an exemplary embodiment, the computerized instructions for controlling one or more games may be executed by a server, such as, for example, a central controller or remote host. In such a "thin client" architecture, the server may remotely control one or more games, or other suitable interfaces, via a gaming network, and the gaming machine may be used to display the games, or suitable interfaces, and to receive inputs or commands from a player.

In another exemplary embodiment, the instructions for controlling one or more games are communicated from a server to a local processor and memory coupled within a gaming machine. In such a "thick client" architecture, a processor of the gaming machine may execute the communicated instructions to control the game or games and/or other suitable interfaces provided to a player.

In another exemplary embodiment, one or more gaming machines within a gaming machine network may utilize a thin client architecture and one or more gaming machines within a gaming machine network may utilize a thick client architecture. Similarly, in various exemplary embodiments, certain functions of a particular gaming machine may be implemented in a thin client architecture and certain other functions of the gaming machine may be implemented in a thick client architecture. For instance, instructions for controlling a game or games may be communicated from a server to one or more network gaming machines operating in a thick client configuration, while instructions for controlling any secondary games or bonus gaming functions may executed by the server in a thin client configuration.

Figure 1:
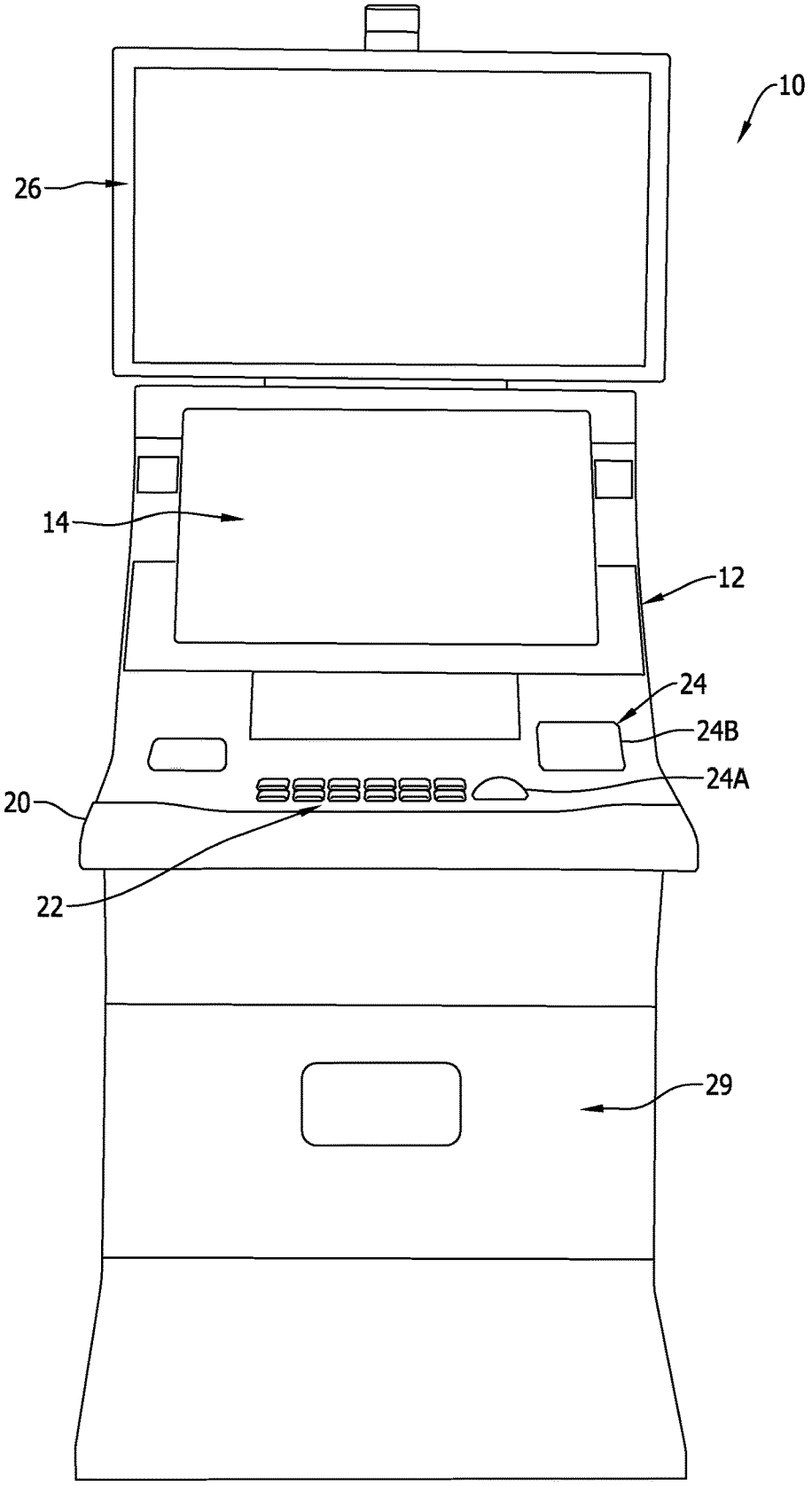
FIG. 1 is a block diagram of exemplary components of a gaming machine.

FIG. 1 is a perspective view of an exemplary gaming machine 10. Gaming machine 10 may include a support structure, housing, console or cabinet 12 that provides support for a plurality of interface units, displays, inputs, controls and other features of a conventional gaming machine. Gaming machine 10 may be configured so that a player can operate it while standing or sitting. Moreover, gaming machine 10 may be positioned on a base or stand, or can be configured as a pub-style table-top game (not shown) that a player can operate while seated. Gaming machine 10 may include varying numbers and styles of cabinets 12, display configurations, and the like without departing from the scope of the present disclosure.

In an exemplary embodiment, gaming machine 10 may include a display 14. Gaming machine 10 may further include a mid-trim 20, which may house a bank of buttons 22 for enabling a player to interact with gaming machine 10 and/or a credit input mechanism 24.

Gaming machine 10 may also include a player marketing module configured to scan or read a player tracking device, such as, for example a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

Gaming machine 10 may further include a top box 26, which may, in turn, include artwork, such as, for example, artwork depicting one or more pay tables, bonus award information, an upper display (not shown), and/or other game information or imagery. Further artwork and/or information may be provided on a front panel 29 of console 12. A coin tray 30 may be mounted beneath front panel 29 for dispensing cash payouts from gaming machine 10.

Display 14 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In an exemplary embodiment, display 14 includes a touch-screen or touch-sensitive screen. In various embodiments, display 14 may be of any suitable size and configuration, such as any circular, square, rectangular, or other geometric configuration.

Display 14 may be further configured to provide haptic feedback. Top box 26 may also include a display, which may be of the same or different from display 14.

Display 14 may, in various embodiments, display a game and/or accept game play data from a player. Moreover, display 14 may also display information relating to an interactive game, wager triggering event, or wagering outcome. In an exemplary embodiment, an upper display (not shown) mounted in top box 26 may display any wagering outcome, any suitable secondary game associated or not associated with the interactive game, or any information relating to the interactive games. The upper display may also be configured to accept game play data from a player.

Display 14 may, in addition, serve as digital signage operable to advertise one or more games or other aspects of the gaming establishment. In an exemplary embodiment, gaming machine 10 may also include a credit or fund display 20, which may display a player's current number of credits, cash accumulated, account balance, an original number of credits the player funded the gaming machine with, or an equivalent of any of the aforementioned, and the like. Moreover, in an exemplary embodiment, display 14 may display an amount being wagered or a player's accumulated winnings.

In an exemplary embodiment, and as described in greater detail herein, display 14 may display at least one game or game image, game symbol or symbols, and game indicia, such as any visual representation or exhibition of a movement of objects, including, for example, any mechanical, virtual, or video reels and wheels, dynamic lighting, video images, images of people, characters, places, things and faces of cards, and the like. In various embodiments, the symbols, images and indicia described above may be displayed mechanically, such as by one or more mechanical or physical reels. In other words, display 14 may include any electromechanical device, such as one or more rotatable or spinning wheels, reels or dice, any of which may be configured to display at least one or a plurality of games or other suitable images, symbols or indicia.

Figure 2:
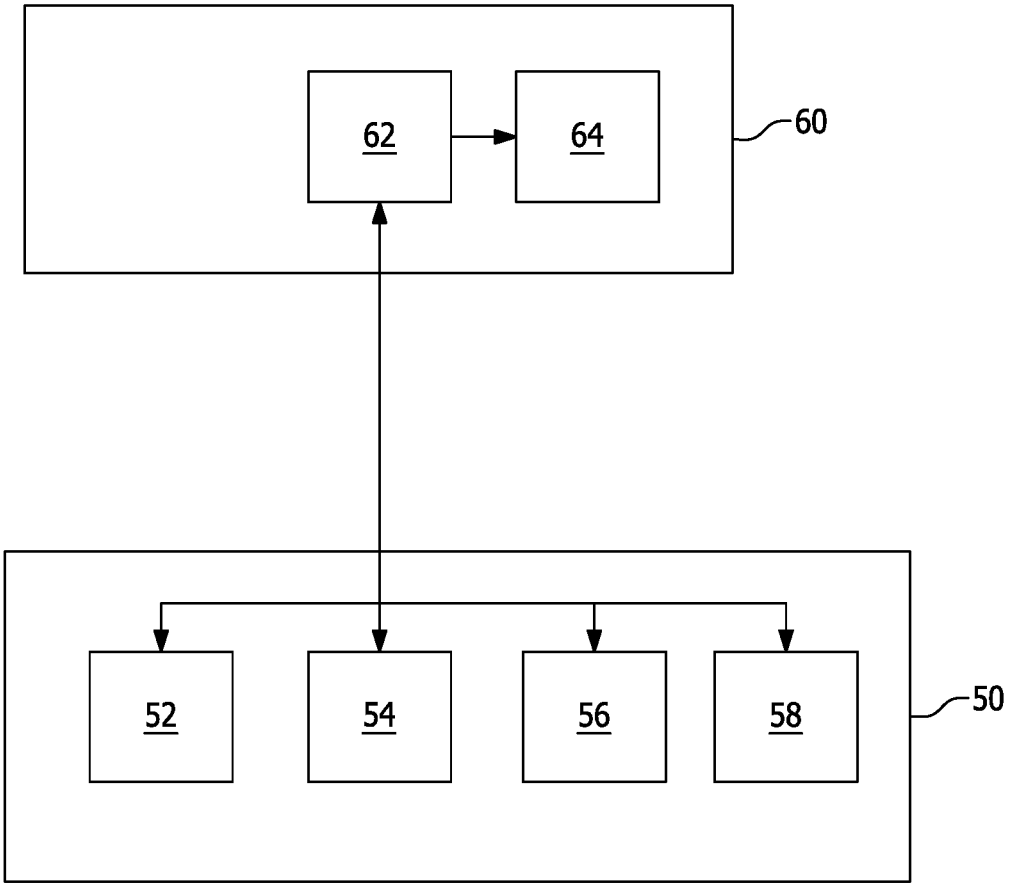
FIG. 2 is a perspective view of an exemplary gaming machine.

FIG. 2 is a block diagram of an exemplary player interface 50 and game controller 60 of gaming machine 10. Player interface 50 and game controller 60 may be housed within gaming machine 10, such as on a printed circuit board located within cabinet 12 of gaming machine 10. As described herein, player interface 50 may be arranged to enable manual interaction between a player and the gaming system and for this purpose includes various input/output components required for the player to enter instructions to play the game and observe the game outcomes.

Components of player interface 50 may include at least one credit input mechanism 24, at least one display 14, a game play mechanism 56 (including one or more input devices that enable a player to input game play instructions or place a wager), and/or one or more audio output devices 58 (e.g., one or more speakers).

Game controller 60 may be in data communication with player interface 50 and may include at least one processor 62 or other suitable controller, such as a microprocessor, a microcontroller-based platform, a suitable integrated circuit or one or more application-specific integrated circuits (ASICs). Processor 62 may be coupled in communication with, or may be operable to access or to exchange signals with, at least one data storage module or memory 64. Processor 62 may thus be configured to retrieve game play instructions from memory 64, process the game play instructions in accordance with game play rules, and output one or more game play outcomes to display 54.

Memory 64 may include any suitable tangible, non-transitory, computer-readable storage medium. Memory 64 may store program code and instructions, executable by processor 62, to control gaming machine 10. Memory 64 may also store other data, such as, for example, image data, one or more pay tables or pay table data, event data, player input data, random or pseudo-random number generators, or numbers generated by a random number of pseudo-random number generator, look-up table data, and/or information and applicable game rules that relate to the play of gaming machine 10.

Figure 3:
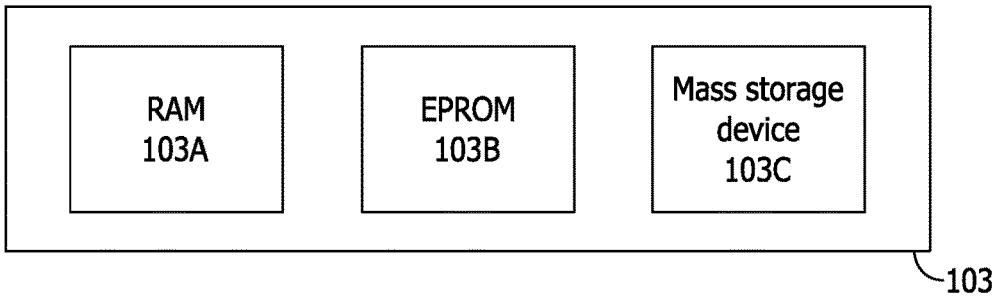
FIG. 3 is a block diagram of exemplary components of a gaming machine.

With brief attention to FIG. 3, a block diagram of memory 64 is shown. Memory 64 may, in various embodiments, include a memory 103 (as described herein with reference to FIG. 3). Memory 103 may include random access memory (RAM) 103A, such as non-volatile RAM (NVRAM), magnetic RAM (MRAM), ferroelectric RAM (FeRAM) and other forms as commonly understood in the gaming industry. Memory 103 may further include read only memory (ROM), such as EPROM 103B or electrically erasable programmable read only memory (EEPROM). Memory 64 may further include one or more mass storage devices 103C, such as one or more hard drives, one or more solid state or flash memory components, one or more CD and/or DVD drives, and the like. Any other suitable magnetic, optical, and/or semiconductor memory may be used to operate in conjunction with gaming machine 10 that enables gaming machine 10 to function as described herein.

In an exemplary embodiment, RAM 103A may temporarily store one or more program files (and/or other related data) for execution by processor 62. EPROM 103B may include a boot ROM device and/or may contain some system or game related code. Mass storage device 103C may store one or more game programs, the integrity of which may be verified and/or authenticated by the processor 62 through the use of protected or encrypted code stored, for example, on EPROM 103B.

In various embodiments, part or all of the program code and/or operating data described above is stored in a detachable or removable memory, including, but not limited to, a suitable cartridge, disk, CD ROM, DVD or USB memory device. In addition, in various embodiments, all or part of the program code and/or operating data described above may be downloadable to memory 64 by way of any suitable computer network.

In an exemplary embodiment, a desktop computer, a laptop personal computer, a personal digital assistant (PDA), a smartphone, a tablet computing device or other portable computing device, and/or any other computerized platform may implement the computing operations of the present disclosure. For example, any suitable mobile computing device, such as any smartphone or tablet computing device, may implement and enable gameplay as described herein. It should be appreciated that each gaming machine 10 disclosed herein may include a device that has obtained approval from a regulatory gaming commission or a device that has not obtained approval from a regulatory gaming commission. It should also be appreciated that processor 62 and memory 64 may be collectively referred to herein as a "computer" or "controller."

Returning to FIG. 1, in an exemplary embodiment, credit input mechanism 24 may be coupled in communication with processor 62. Credit input mechanism 24 may include any suitable credit input mechanism or device, such as a coin input chute 24A, a bill or ticket collector 24B, and the like. Credit input mechanism may be configured to receive any suitable monetary credit, such as money, coins, tokens, tickets, and the like. In various embodiments, credit input mechanism 24 may further include card reader devices, such as credit or debit card readers or validators for credit cards, debit cards, printed ticket printers and/or readers, and the like.

In various embodiments, a player may insert an identification card (not shown) into a card reader of gaming machine 10. The identification card may be a smart card that includes a programmed microchip or a magnetic strip coded with a player's identification, credit totals (or related data) and other relevant information. A player may further carry a portable device, such as a cell phone or smart phone, a radio frequency identification tag or any other suitable wireless communication device, which communicates a player's identification, credit totals (or related data) and other relevant information to gaming machine 10. In an embodiment, money may be transferred to gaming machine 10 via an electronic funds transfer process. When a player funds gaming machine 10, processor 62 may determine an amount of funds entered and display the corresponding amount on the display 14.

Game play mechanism 56 may include at least one input device that is coupled in communication with processor 62. An input device may include any device that enables a player to produce an input signal that is receivable by processor 62. For example, in one embodiment, after funding gaming machine 10, the input device may include a game activation device, such as a pull arm or one or more play button 22 that enables the player to start the game or a sequence of events in gaming machine 10. Play button 22 may include any suitable play activator such as a bet one button, a max bet button, or a repeat the bet button. In an embodiment, after appropriate funding of gaming machine 10, game play may begin automatically.

In an exemplary embodiment, one input device may include a "Bet One" button. A player may place a wager or bet by pushing the Bet One button and may increase the wager by repeatedly depressing or selecting the Bet One button. In various embodiments, an input device includes a "Bet Max" button that enables a player to place a maximum wager permitted during a particular game or game session.

In various embodiments, an input device may also include a "Cash Out" button. A player may depress or select a Cash Out button to receive a cash payment or other suitable form of payment corresponding to the number of credits remaining. In an embodiment, when the player cashes out, the player receives coins or tokens in a coin payout tray. A player may further receive tickets or credit slips, or the player's electronically recordable identification card may be funded, in response to selection of a Cash Out button.

In various embodiments, an input device may include a touch-screen that is coupled to a touch-screen controller, or some other touch-sensitive display overlay, to enable player interaction with images presented on display 14. A touch-screen and/or touch-screen controller may be communicatively coupled to a video controller, such that a player may provide input signals to gaming machine 10 by physically manipulating or interacting with the touch-screen.

Gaming machine 10 may include a sensor, such as a camera (not shown) coupled in communication with processor 62. The camera may, in various embodiments, be controlled by processor 62, such that a player may direct the orientation and focus of the camera to acquire an image of a player actively playing gaming machine 10 and/or a surrounding area of gaming machine 10. In an exemplary embodiment, the camera may selectively acquire still or moving (e.g., video) images and may be configured to acquire the images in either an analog, digital, or other suitable format. Display 14 may be configured to display the image acquired by the camera, as well as to display the visible manifestation of the game in split screen or picture-in-picture fashion. For example, the camera may acquire an image of the player and processor 62 may incorporate that image into the interactive and/or secondary game as a game image, symbol or indicia.

Figure 4:
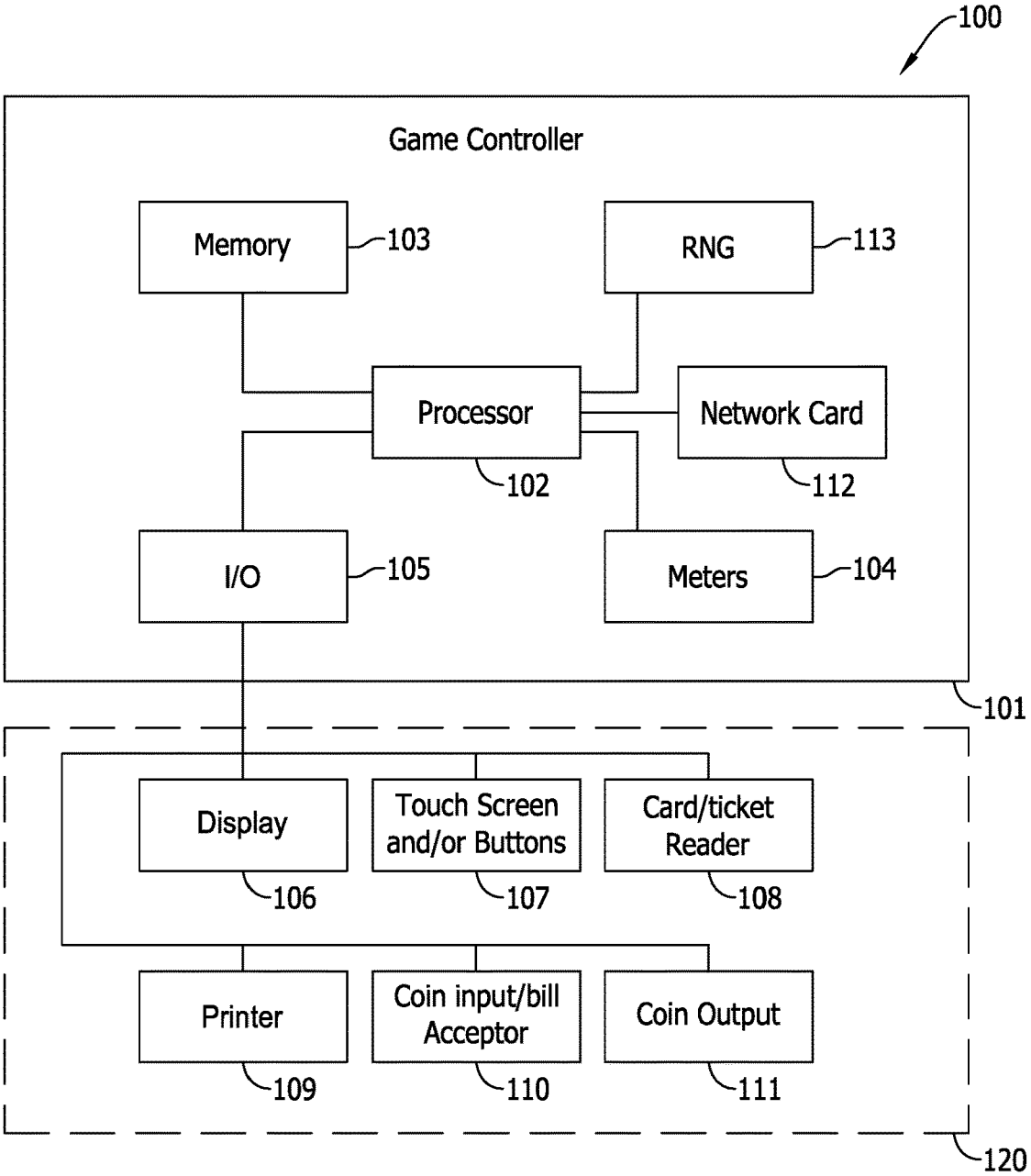
FIG. 4 is a schematic diagram of exemplary components of a memory.

FIG. 4 illustrates a more detailed block diagram of various exemplary functional components of a gaming machine 100, which may be the same as or different from gaming machine 10 (as shown in FIG. 2). The foregoing description of components (e.g., display 14, player interface 50, and game controller 60) may therefore apply to the description of similar components in gaming machine 100. For instance, processor 62 may be the same as or different from 102, as described below. Similarly, memory 64 may be the same as or different from memory 103 as described below.

Accordingly, gaming machine 100 may include a game controller 101 (which may include a processor 102 mounted on a circuit board, as described in greater detail above). Instructions and data to control operation of processor 102 may be stored in a memory 103 that is in data communication with processor 102. Gaming machine 100 may include both volatile and non-volatile memory and more than one of each type of memory, with such memories being collectively represented by memory 103.

Gaming machine 100 may further include hardware meters 104 (to ensure regulatory compliance and to monitor player credit) and/or an input/output (I/O) interface 105 (for communicating with peripheral devices of gaming machine 100). Input/output interface 105 and/or the peripheral devices may include intelligent devices with their own memory for storing associated instructions and data. A random number generator module 113 may generate random numbers for use by processor 102. Persons skilled in the art will appreciate that random number generator module 113 includes a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, and a coin output mechanism 111. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game).

Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information and/or other information to a bonus controller, central controller, server or database and receive data or commands from the bonus controller, central controller, an/or server or database. In various embodiments (e.g., embodiments that employ a player marketing module), communications over a network may be via the player marketing module—e.g., the player marketing module may be in data communication with one or more of the above devices.

In various embodiments, components of gaming machine 100 may be distributed. For example, in an embodiment, input/output devices 106, 107, 108, 109, 110, and 111 may be provided remotely from game controller 101.

Figure 5:
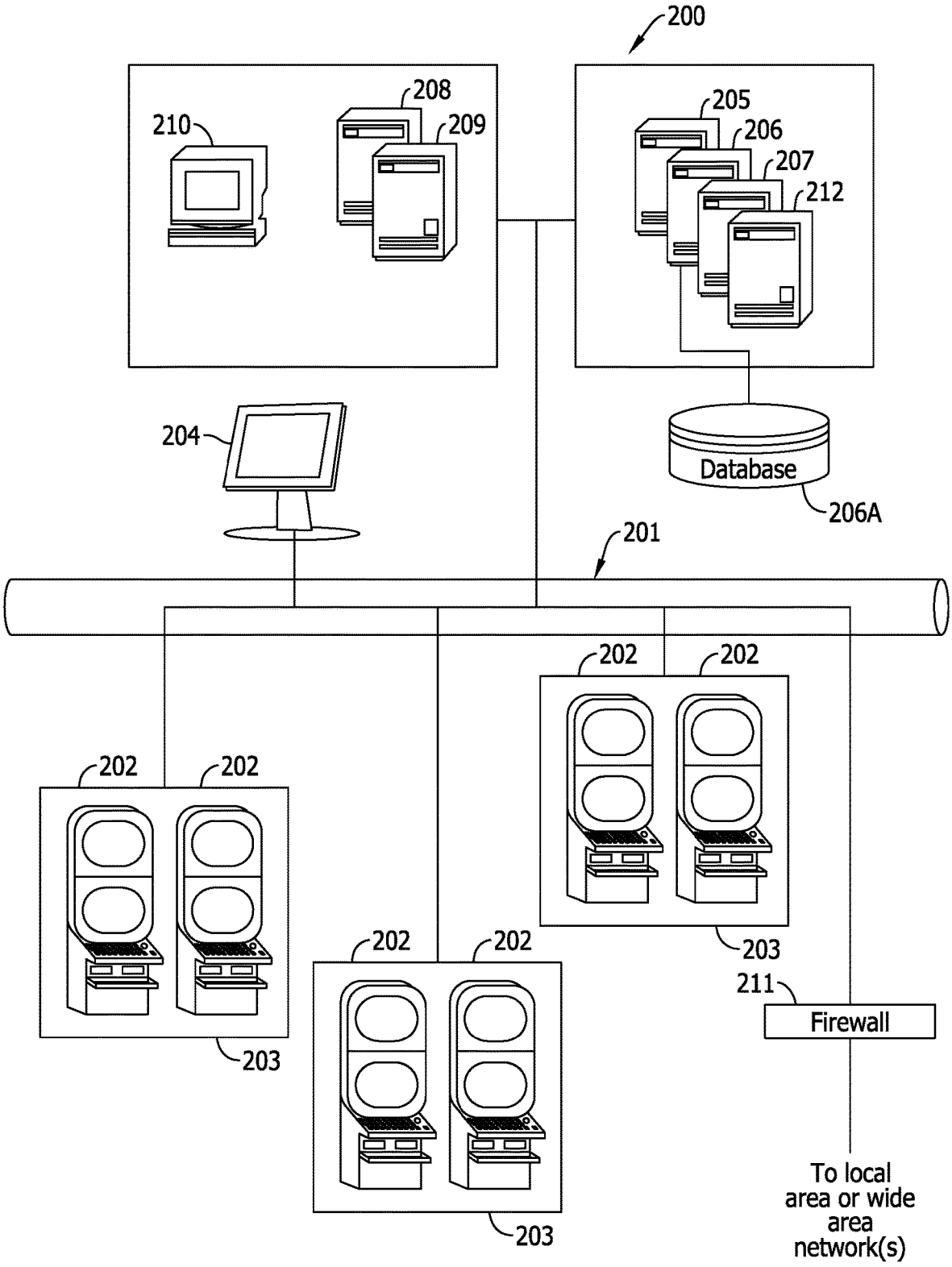
FIG. 5 is a schematic diagram of an exemplary network gaming system.

FIG. 5 illustrates such an exemplary distributed gaming system 200. Gaming system 200 may include a network 201, which, for example, may include a wired or wireless network, such as a Wi-Fi or BLUETOOTH network, an Ethernet network, an RS-232 network, and/or any combination thereof. In an exemplary embodiment, gaming machines 202, shown arranged in three banks 203 of two gaming machines 202, are connected to network 201. Gaming machines 202 may provide a player operable interface and may be the same as (or substantially similar to) the gaming machines 10 and 100 (as shown in FIGS. 2 and 3), or may have simplified functionality depending, for example, on various game play requirements.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example promotional or informational material. Displays 204 may be the same as or substantially similar to display 14, as described above.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively include a game controller. A database management server 206 may manage storage of game programs and associated data for downloading or access by gaming machines 202 in a database 206A. Typically, if gaming system 200 enables players to participate in a jackpot game, a jackpot server 207 may be provided to perform accounting functions for the jackpot game. A loyalty program server 212 may also be provided.

In a thin client embodiment, game server 205 may implement most or all of the game played by a player using gaming machine 202, and gaming machine 202 may, in essence, function provide little more than the player interface. In such an embodiment, game server 205 may include the game controller. Gaming machine 202 may thus receive player instructions and transmit those instructions to game server 205. Further, in a thin client embodiment, gaming machines 202 may be computer terminals, such as, for example, personal computers, laptop computers, tablet computing devices, smartphones, and the like running software that provides a player interface. Other client/server configurations are contemplated and are within the scope of this disclosure. Additional details of a client/server architecture may be found in WO 2006/052213 and PCT/SE2006/000559, the disclosures of which are incorporated herein by reference in their entireties.

One or more servers may be provided to assist in the administration of gaming system 200. Such servers may include, for example, a gaming floor management server 208, and a licensing server 209 to monitor the use of licenses relating to particular games. An administrator terminal 210 may be provided to allow an administrator to run network 201 and the devices connected to network 201.

Gaming system 200 may communicate with other gaming systems and/or other local networks, such as, for example a corporate network, and/or a wide area network such as the Internet Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 may implement a random number generator engine. Alternatively, a separate random number generator server may be provided. Further, persons skilled in the art will appreciate that a plurality of game servers may be provided to implement different games or a single game server may implement a plurality of different games as required by the terminals.

In an exemplary embodiment, a player may place a wager using the game play mechanism 56. A game (or game session) may be initiated in response to placement of the wager, a plurality of symbols randomly drawn, and a game (or game session) outcome determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In various embodiments, a wager may include a selection of a number of lines to be played during a game session. Such lines may include an interconnected combination of symbol display positions. Each selected line may be evaluated to identify winning combinations of symbols. A pay table (e.g., a pay table stored in memory 64) may be referenced to identify a payout or award based upon an identified winning combination of symbols. In various embodiments, an award may be multiplied or increased by a multiplication factor as well.

In an exemplary embodiment, gaming machine 202 may generate an award that is not based solely upon a number of a lines selected. For example, "scatter" pays (e.g., randomly selected awards that are not identified based upon a plurality of adjacent symbols) may be awarded independently of a player's selection of pay lines.

Throughout this specification and in the claims, the terms "primary game" and "bonus game" refer to a game session that includes more than one game event or, simply, one or more games. The primary game may correspond to a primary or "base" game, as opposed to a bonus game, as described below. The primary game may be initiated in response to a wager or credit being received by or transferred to gaming machine 10 (shown in FIG. 1). The primary game (as well as one or more games comprising the primary game) may also be initiated by other game events including, for example, a player selecting a "spin" button, a start button, a deal button, or any other such input selector designated for initiating a game session. The primary game may be terminated voluntarily in response to an input by the player indicating that the player wishes to stop the game or automatically by the gaming device in response to a termination event, such as a zero credit balance in the reel game.

Further, as used herein, the terms "bonus game," "secondary game," "bonus game session," and "bonus feature" refer generally to a game or a component of a game involving procedures in addition to the primary game. The bonus game may be initiated after, or during, the primary game and in response to a particular condition occurring during the primary game. The bonus game may include a plurality of bonus game events. For example, where the primary game includes a slot machine game, the bonus game may allow players a possibility of winning more than the pay table for the primary game indicates. Typically, a bonus game outcome may depend upon a particular symbol being displayed when one of a plurality of final game events takes place. In addition, the bonus game outcome may depend upon winning a payout while gaming machine 10 is in a bonus mode or "zone." In various embodiments, the outcome of the bonus game may be unrelated to the outcome of the primary game.

As used herein, the term "reel strip" may be used to refer to a column of symbol display positions. Each symbol display position may be displayed or located on a physical reel or a virtual reel. In the exemplary embodiment, gaming machine 10 may display six reel strips, each having six symbol display positions, for a total of thirty six symbol display positions. A symbol display position may further display a symbol, such as a symbol selected by game controller 60.

Figure 6:
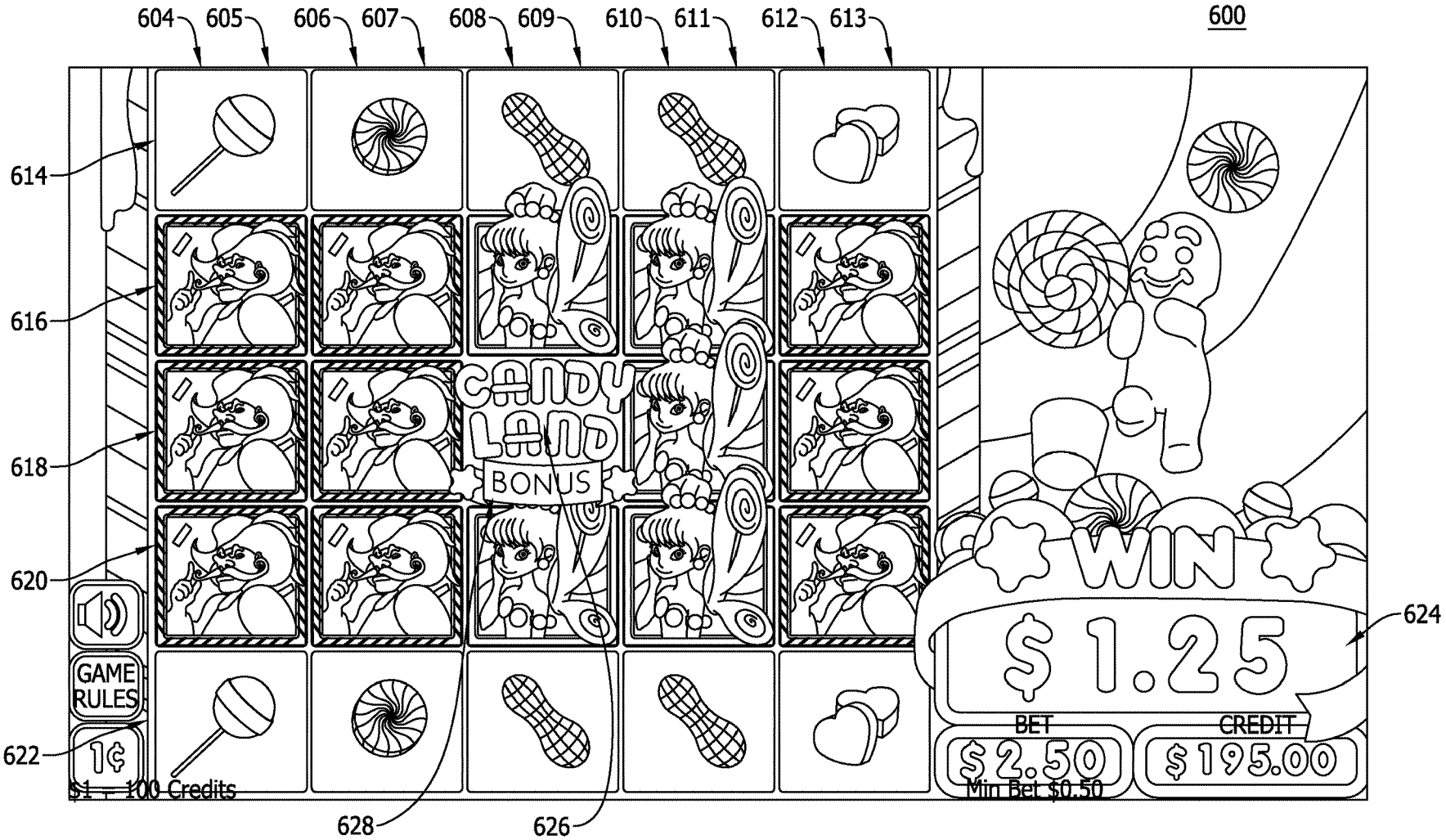
FIG. 6 is an exemplary screenshot that may be displayed in which a primary game is displayed.
Figure 7:
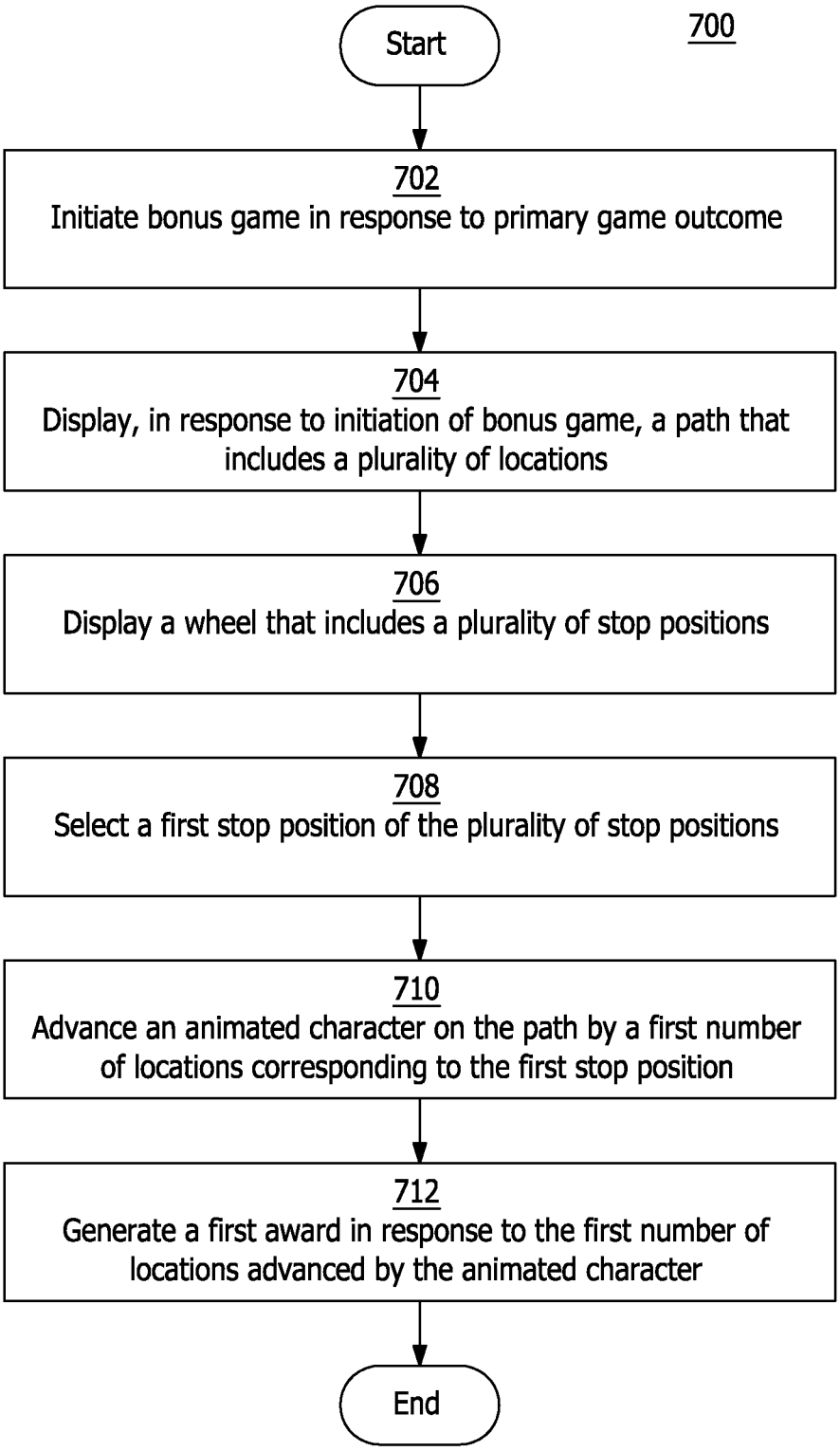
FIG. 7 is a flowchart of an exemplary method of electronic gaming.
Figure 8:
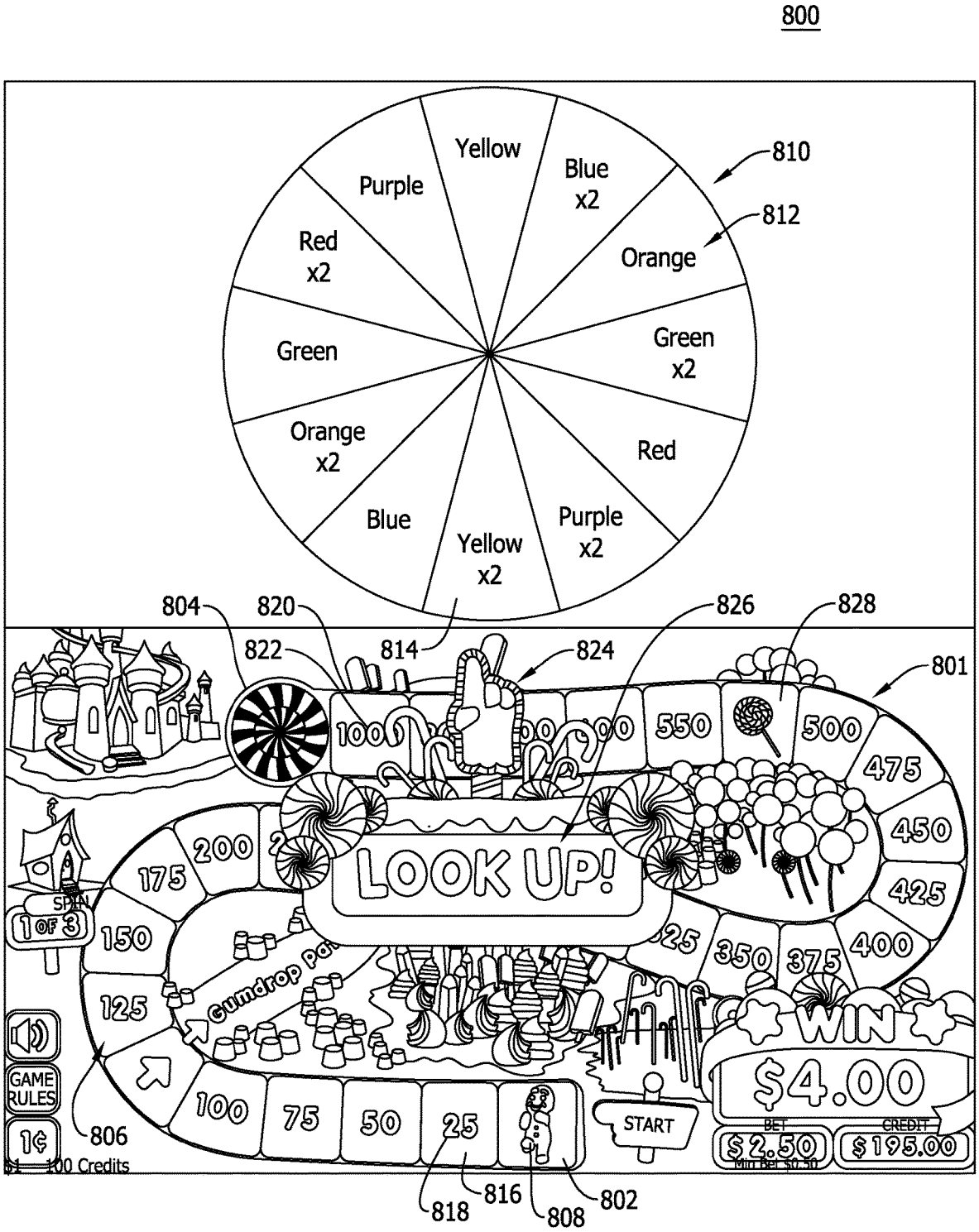
FIG. 8 is an exemplary screenshot that may be displayed in which a path based bonus feature is displayed.
Figure 9:
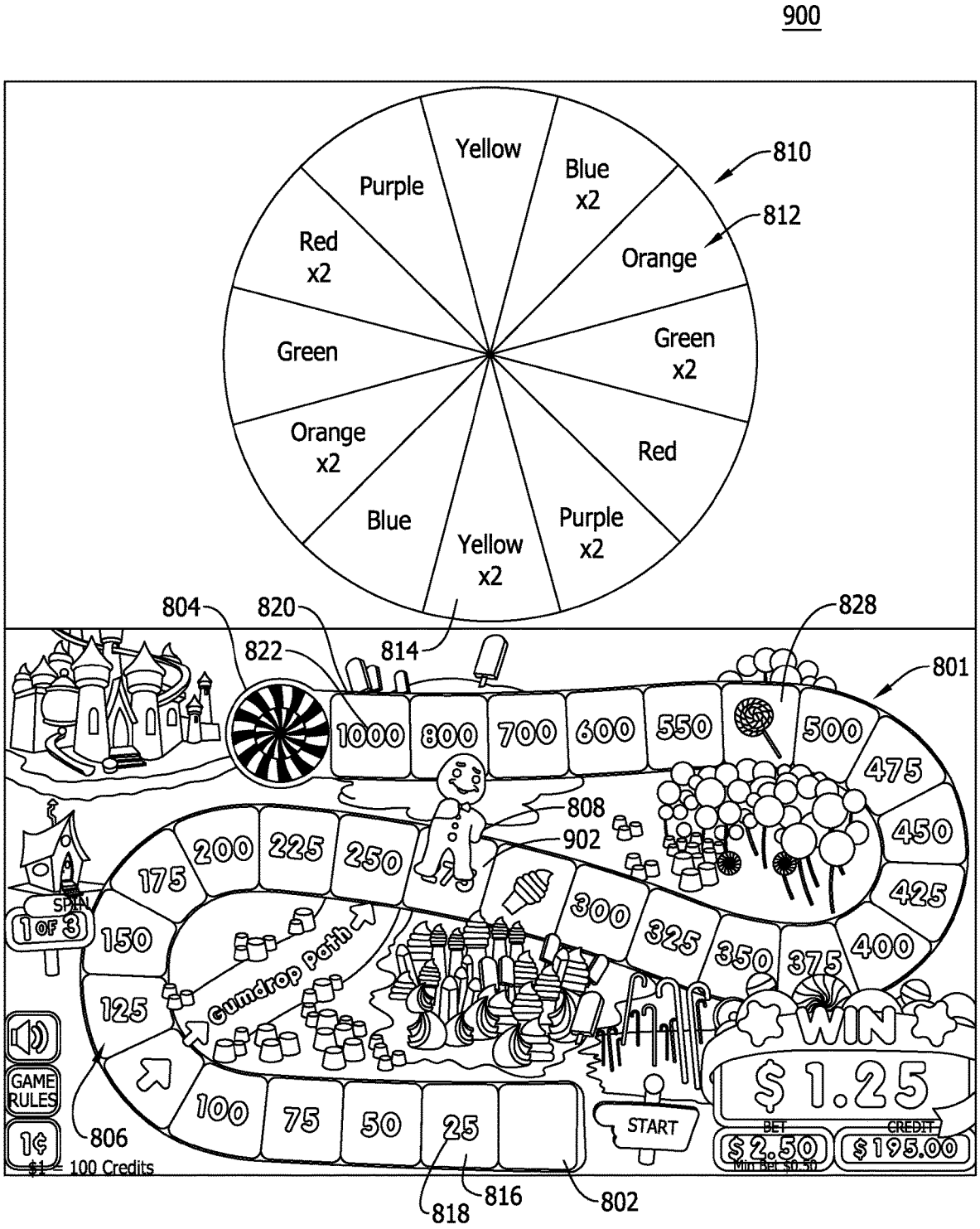
FIG. 9 is an exemplary screenshot that may be displayed in which a path based bonus feature is displayed, and in which an animated character advances along the path.

FIGS. 6, 8, and 9 are screenshots intended to illustrate gameplay, and FIG. 7 is a flowchart of an exemplary method 700 of implementing an electronic bonus game. The path based bonus game described below with reference to FIGS.

6-9 is merely illustrative, however, and many other gameplay variations are contemplated and within the scope of this disclosure. Thus, the exemplary gameplay described below should not be construed as limiting the scope of this disclosure but as generally illustrative of gameplay in accordance with method 700.

Accordingly, with attention now to FIG. 6, an exemplary screenshot 600 illustrating primary game play is shown. Game controller 60 (shown in FIG. 2) may implement the primary game. As such, in the exemplary embodiment, game controller 60 may generate a plurality of reel strips as part of the primary game. Each reel strip may be displayed on a display, such as display 14 (shown in FIG. 1). For example, as shown, game controller 60 may generate five reel strips, such as reel strips 604, 606, 608, 610, and 612. However, in other embodiments, game controller 60 may generate any other suitable number of reel strips.

Each reel strip 604-612 may also span a number of rows, such as rows 614, 616, 618, 620, and 622. As such, each reel strip 604-612 may include a plurality of symbol display positions, such as a first plurality of symbol display positions 605, a second plurality of symbol display positions 607, a third plurality of symbol display positions 609, a fourth plurality of symbol display positions 611, and a fifth plurality of symbol display positions 613. In the exemplary embodiment, each reel strip 604-612 includes five symbol display positions spanning five rows 614-622. However, in other embodiments, each reel strip 604-612 may include any suitable number of symbol display positions spanning any suitable number of rows.

Having generated reel strips 604-612, game controller 60 may select a plurality of symbol display positions, such as, for example, symbol display positions at rows 616, 618, and 620. Game controller 60 may evaluate the selected symbol display positions (e.g., at rows 616-620), and, based upon the analysis, determine whether to generate a primary game award, such as a primary game award 624. As described above, the primary game award may be based upon a pay table and displayed on display 14 for the player.

In addition, game controller 60 may, in some embodiments, select a bonus game trigger symbol, such as a bonus game trigger symbol 626, during primary game play. The bonus game trigger symbol 626 may appear at any of symbol display positions 605-613 on any of reel strips 604-612. In one embodiment, the bonus game trigger symbol 626 may be displayed on a central symbol display position 628. However, in other embodiments, the bonus game trigger symbol 626 may appear in any symbol display position 605-613. In response to selection of bonus game trigger symbol 626, game controller 60 may initiate a bonus game, as described below.

Accordingly, with attention now to FIGS. 7, 8, and 9 an exemplary method 700 of electronic gaming is shown in FIG. 7 in conjunction with exemplary screenshots 800 and 900 illustrating bonus game play. Game controller 60 (shown in FIG. 2) may execute method 700 as part of a bonus game, which may be triggered or initiated 702 as a result of a primary game outcome and/or as a result of bonus game trigger symbol 626, as described above (e.g., with reference to FIG. 6). In other words, in some embodiments, method 700 may be implemented as part of a bonus game.

During the bonus game, a player may be allocated any number of initial spins. For example, in some embodiments, a player may be allocated three initial spins. The player may initiate each spin using a button or other input component of game play mechanism 56. Further, in the event that game controller 60 selects a stop position of a wheel (as described below) during one of the three initial spins, one or more additional spins may be added to the player's total number of bonus spins remaining, thereby increasing the duration of the bonus game implemented by method 600. In one embodiment, selection of at least one stop position by game controller 60 during, one of the three initial spins, adds three additional spins to the total number of spins remaining. Further, in some embodiments, each time game controller 60 selects at least one stop position, one or more spins may be added to the number of spins remaining. Thus, the bonus game may continue indefinitely until the player exhausts the number of spins allocated during the bonus game and/or until the player reaches an end location of the path (as described below).

With reference now to FIG. 8, during the bonus game, game controller 60 may display 704 a path 801. Path 801 may include a start location 802, such as a start tile, an end location 804, such as an end tile, and a plurality of intermediate locations 806, or intermediate tiles, extending therebetween. Each location 802-806 may be adjacent to at least one other location 802-806, such that the locations 802-806 are arranged to form path 801, and such that, during bonus game play, an animated character 808, such as a gingerbread man, may advance from one location 802-806 to another location 802-806. For instance, in the exemplary embodiment, the animated character 808 may begin, at the start of the bonus game, at start location 802 and may advance along path 801 towards end location 804 as the bonus game continues.

Each location 802-806 and/or each intermediate location 804 may be associated with a color. For instance, each location 802-806 and/or each intermediate location 804 may be a colored tile. The colors associated with each location 802-806 may be any suitable color, such as purple, yellow, blue, orange, green, and/or red, and may be applied randomly and/or in any suitable pattern to locations 802-806. Thus, path 801 may include a plurality colored tiles.

Locations 802-806 may also be associated with an award or credit value. For example, and as shown, locations 802-806 may be associated with awards or credit values that increase from start location 802 towards end location 804. More particularly, a first intermediate location 816 may be associated with a first award or credit value 818, and a final intermediate location 820 may be associated with a final award or credit value 822. In the exemplary embodiment, the first award or credit value 818 may be a credit value of twenty-five, and the last award or credit value may be a credit value of one-thousand. The plurality of intermediate locations 806 extending between first intermediate location 816 and final intermediate location 820 may be associated with awards or credit values that increase in the direction of final intermediate location 820, such as, for example, in multiples of twenty-five credits per location or tile.

The bonus game may, in addition, include a wheel 810, which may be displayed 706 in conjunction with path 801. In some embodiments, wheel 810 may be displayed in a secondary top box display, such as a display mounted in top box 26. In other embodiments, wheel 810 may be displayed as part of a separate structure mounted behind and/or overtop the gaming machine 10 on which path 801 is displayed. Thus, in general, wheel 810 may be displayed at any location or position from which wheel 810 may be viewed by a player who is playing the bonus game on gaming machine 10 and/or by a plurality of players who are playing the bonus game, such as by a plurality of players who are playing the bonus game on a plurality of networked gaming machines 202.

In the exemplary embodiment, wheel 810 may be divided into a plurality of wedges or stop positions 812, each of which may be associated with a particular color, such as a color corresponding to one of locations 802-806. For example, each stop position of the plurality of stop positions 812 may, like locations 802-806, be associated with a color, such as, for example, purple, yellow, blue, orange, green, and/or red. Further, in various embodiments, certain stop positions of the plurality of stop positions 812 may include a multiplier (not shown), such as a "times two," times three," and/or "times four" multiplier, which may allow animated character 808, as described below, to advance to a particular location 802-806 on path 801.

Accordingly, game controller 60 may cause wheel 810 to spin in response to a spin or wager initiated, as described above, by a player during the bonus game. Game controller 60 may, as wheel 810 spins, select 708 a first stop position 814 on wheel 810, and wheel 810 may come to a stop at first stop position 814. First stop position 814 may be associated with a particular color, such as in the example illustrated at FIG. 8, the color yellow. A pointer 824 may appear over path 801 to indicate a location of wheel 810 as well as to indicate to the player that the player should watch wheel 810. In the exemplary embodiment, pointer 824 may appear with a message 826, such as a message reading "LOOK UP!"

With reference now to FIG. 9, game controller 60 may move or advance 710 animated character 808 along path 801 based upon, and in response to, first stop position 814. For example, where first stop position 814 is associated with the color yellow, game controller 60 may advance animated character 808 to a first yellow location, such as first yellow location 902. In addition, and as described above, if first stop position 814 is associated with a multiplier, such as a "times two," times three," and/or "times four" multiplier, game controller 60 may, in some embodiments, advance animated character 808 to a second, third, or fourth yellow location along path 801, respectively.

In addition, as animated character 808 is advanced to a particular location, such as first yellow location 902, game controller 60 may generate 712 an award, such as an award 904, based upon the award and/or credit value shown in conjunction with the particular location. In the case of first yellow location 902, a credit value of two-hundred-and-seventy-five credits may be awarded to the player.

The bonus game may progress in this fashion until the player has exhausted the number of bonus spins allocated to the player (as described above). Thus, the player may repeatedly select an option to spin wheel 810, and with each spin of wheel 810, animated character 808 may advance to a colored intermediate location 806 that matches the color of the stop location of wheel 810 selected by game controller 60. In some embodiments, animated character 808 may advance, as a result of one or more spins, to end location 804, and a jackpot award may be generated as a result.

In addition, in various embodiments, animated character 808 may advance to and/or pass over a particular location, such as a feature trigger location 828. Feature trigger location 828 may be activated if animated character passes over feature trigger location 828 during gameplay and/or if animated character advances to feature trigger location 828. In either case, feature trigger location 828, which may be identified, for example, by a lollipop and/or an ice cream cone, may trigger an additional gameplay feature, such as an additional bonus game. For instance, feature trigger location 828 may trigger any suitable bonus game, such as pick game, an additional path game, a reel-based bonus game, and the like.

Embodiments of the gaming machines and systems, as described above, facilitate play of a bonus game in which a path is generated and displayed, and in which an animated character advances from one location to another location along the path based upon a stop position selected by a game controller on a wheel displayed in conjunction with the path. The wheel may be divided into one or more colored wedges or colored stop positions, and the animated character may advance to a location along the path that matches the color associated with the selected wedge or stop position. Hence, the gaming machines and systems described herein facilitate a new and exciting bonus game in which a player traverses a path based upon a stop position of a wheel displayed in conjunction with the path.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

Exemplary embodiments of a system, method, and article of manufacture for electronic gaming and related components are described above in detail. The disclosure is not limited to the specific embodiments described herein, but rather, components of the systems and/or articles and/or steps of the methods may be utilized independently and separately from other components and/or steps described herein. For example, the configuration of components described herein may also be used in combination with other processes, and is not limited to practice with the systems, articles, and related methods as described herein. Rather, the exemplary embodiment can be implemented and utilized in connection with many applications in which a game or bonus game is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of electronic gaming implemented using a gaming system, the gaming system including a display configured to display a wagering game, a player input interface, a credit input mechanism, the credit input mechanism configured to establish a credit balance that is increasable and decreasable based on wagering activity, a tangible, non-transitory, computer-readable memory, and a game controller communicatively coupled to the memory, the method comprising:

initiating, by the game controller and in response to a primary game outcome of the wagering game, a bonus game;

awarding an initial number of spins for use in the bonus game;

displaying, by the display and in response to the initiating, a multicolored path, the multicolored path originating at a starting position and including a plurality of locations in series after the starting position, each location of the plurality of locations having one color of a first plurality of colors associated therewith and a bonus award symbol, of a plurality of bonus award symbols, wherein the color associated with a particular location is randomly selected from the first plurality of colors such that each different instance of the bonus game includes a differently colored multicolored path that includes locations along the path including colors that are randomly selected from the first plurality of colors, and wherein the bonus award symbol comprises a bonus award value, wherein each of the bonus award values increases in value from each location of the plurality of locations to an adjacent location of the plurality of locations along the multicolored path;

displaying, by the display and in response to the initiating, an animated character at the starting position on the multicolored path;

displaying, by the display, a multicolored wheel, the multicolored wheel including a plurality of stop positions, each stop position of the plurality of stop positions including one color of a second plurality of colors;

simulating, by the game controller, a spin of the multicolored wheel that includes a simulated spinning and stopping of the multicolored wheel with a pointer pointing to a first stop position of the plurality of stop positions, the first stop position including a first color of the second plurality of colors;

decrementing the initial number of spins in response to the simulated spin of the multicolored wheel;

advancing, by the game controller and in response to the simulated spin of the multicolored wheel, an animated character on the multicolored path from one of the starting position and a first location to a second location on the multicolored path, wherein the second location is a next location on the multicolored path from the one of the starting position and the first location, the second location having a color that matches the first color of the first stop position of the multicolored wheel;

stopping the animated character at a final location on the multicolored path when the initial number of spins remaining is zero; and awarding, by the game controller, the bonus award value associated with the final location and the bonus award value associated with the second location.

2. The method of claim 1, further comprising generating, by the game controller, a first award in response to the advancing the animated character to the second location.

3. The method of claim 1, wherein the animated character appears to further advance along the multicolored path from the second location to subsequent locations, based upon a color of each subsequent stop position of the multicolored wheel, until the bonus game is complete, the method further comprising, at the second location and each subsequent location, providing a bonus award associated with the second location and each subsequent location, respectively.

4. The method of claim 1, further comprising:

spinning and stopping, by the game controller, the multicolored wheel on a second stop position of the plurality of stop positions, the second stop position showing a second color different from the first color; and advancing, by the game controller, the animated character on the multicolored path from the second location to a third location matching the second color, wherein at least one intermediate location showing a color different from the first color and the second color appears between the second location and the third location.

5. The method of claim 4, further comprising generating, by the game controller, a second award in response to the advancing the animated character to the third location.

6. An electronic gaming system comprising:

a display;

a player input interface;

a credit input device;

a game controller; and a memory having instructions stored thereon that, in response to execution by the game controller, cause the game controller to at least:

initiate a secondary game in response to an outcome of a primary game;

allocate a number of spins associated with the secondary game;

display a multicolored path, the multicolored path originating at a starting position including a plurality of locations in series after the starting position, each location of the plurality of locations having one color of a first plurality of colors associated therewith and a secondary game symbol, of a plurality of secondary game symbols, wherein the color associated with a particular location is randomly selected from the first plurality of colors such that each different instance of the secondary game includes a differently colored multicolored path that includes locations along the path including colors that are randomly selected from the first plurality of colors, and wherein the secondary game symbol comprises a credit value, wherein each of the credit values increases in value from each location of the plurality of locations to an adjacent location of the plurality of locations along the multicolored path;

display, by the display and in response to the initiating, an animated character at the starting position on the multicolored path;

activate a multicolored wheel, the multicolored wheel including a plurality of stop positions, each stop position of the plurality of stop positions including one color of a second plurality of colors;

cause a spin of the multicolored wheel that includes spinning and stopping of the multicolored wheel with a pointer pointing to a first stop position of the plurality of stop positions, the first stop position including a first color of the second plurality of colors;

decrement the number of spins remaining based on the spin of the multicolored wheel;

advance, in response to the spin of the multicolored wheel, an animated character on the multicolored path from one of the starting position and a first location to a second location on the multicolored path, wherein the second location is a next location on the multicolored path from the one of the starting position and the first location, the second location having a color that matches the first color of the first stop position of the multicolored wheel;

stop the animated character at a final location of the multicolored path when the number of spins remaining is zero; and update a displayed credit fund based on the credit values for the final location and the second location.

7. The electronic gaming system of claim 6, wherein the instructions further cause the game controller to generate a first award in response to the advancing the animated character to the second location.

8. The electronic gaming system of claim 6, wherein the animated character appears to further advance along the multicolored path from the second location to subsequent locations, based upon a color of each subsequent stop position of the multicolored wheel, until the secondary game is complete.

9. The electronic gaming system of claim 6, wherein the instructions further cause the game controller to:

spin and stop the multicolored wheel on a second stop position of the plurality of stop positions, the second stop position showing a second color of the second plurality of colors different from the first color; and advance the animated character on the multicolored path from the second location to a third location matching the second color, wherein at least one intermediate location showing a color different from the first color and the second color appears between the second location and the third location.

10. The electronic gaming system of claim 9, wherein the instructions further cause the game controller to generate a second award in response to the advancing the animated character to the third location.

11. A tangible, non-transitory, computer-readable storage medium having computer-executable instructions embodied thereon, wherein when executed by at least one processor, the computer-executable instructions cause the at least one processor to:

initiate, in response to a primary game outcome, a bonus game;

determine a number of spins for use in the bonus game;

cause display, in response to the initiating, of a multicolored path, the multicolored path including a plurality of locations, each location of the plurality of locations having one color of a first plurality of colors associated therewith and a bonus symbol, of a plurality of bonus symbols, wherein the color associated with a particular location is randomly selected from the first plurality of colors such that each different instance of the bonus game includes a differently colored multicolored path that includes locations along the path including colors that are randomly selected from the first plurality of colors, and wherein the bonus symbol comprises one of a bonus value and a feature trigger symbol of one or more feature trigger symbols, wherein each of the bonus values increases in value along the multicolored path;

trigger a spin of a multicolored wheel that includes spinning and stopping of the multicolored wheel with a pointer pointing to a first stop position of a plurality of stop positions on the multicolored wheel, the first stop position including a first color of a second plurality of colors for the multicolored wheel, wherein each stop position of the plurality of stop positions includes one color of the second plurality of colors;

decrement the number of spins remaining after the triggered spin of the multicolored wheel;

advance, in response to the triggered spin of the multicolored wheel, an animated character on the multicolored path from a first location to a second location on the multicolored path, wherein the second location is a next location on the multicolored path from the first location having a color that matches the first color;

determine one of: i) that the bonus symbol of the second location includes one of the one or more feature trigger symbols associated therewith or ii) that the animated character passed a location on the multicolored path having a bonus symbol that includes the one of the one or more feature trigger symbols associated therewith when the animated character was advanced to the second location;

initiate, in response to the determining, a different bonus game;

return gameplay to the bonus game after the different bonus game is complete; and stop the animated character at a final location when the number of spins remaining is zero; and cause display of the bonus value associated with the final location of the animated character.

12. The computer-readable storage medium of claim 11, wherein the computer-executable instructions further cause the game controller to generate a first award in response to the advancing the animated character to the second location.

13. The computer-readable storage medium of claim 11, wherein the animated character appears to further advance along the multicolored path from the second location to subsequent locations, based upon a color of each subsequent stop position of the multicolored wheel, until the bonus game is complete.

14. The computer-readable storage medium of claim 11, wherein the first location of the multicolored path is a starting location of the multicolored path.

15. The computer-readable storage medium of claim 11, wherein the computer-executable instructions further cause the game controller to:

spin and stop the multicolored wheel on a second stop position of the plurality of stop positions, the second stop position showing a second color different from the first color; and advance the animated character on the multicolored path from the second location to a third location matching the second color, wherein at least one intermediate location showing a color different from the first color and the second color appears between the second location and the third location.

16. The computer-readable storage medium of claim 15, wherein the computer-executable instructions further cause the game controller to generate a second award in response to the advancing the animated character to the third location.

17. The method of claim 1 further comprising generating, by the game controller, a bonus award each time the animated character is advanced to a colored location of the multicolored path.

18. The method of claim 1, wherein at least one colored location of the multicolored path is associated with a credit multiplier, the method further comprising generating, by the game controller, a multiplied bonus award based upon the credit multiplier when the animated character is advanced to the at least one colored location of the multicolored path.

19. The method of claim 1, further comprising simulating, by the game controller, one or more subsequent spins of the multicolored wheel to further advance the animated character on the multicolored path if there is at least one spin of the number of spins remaining.

20. The electronic gaming system of claim 6, wherein the instructions further cause the game controller to simulate one or more subsequent spins of the multicolored wheel to further advance the animated character on the multicolored path if there is at least one spin of the number of spins remaining.

21. The computer-readable storage medium of claim 11, wherein the computer-executable instructions further cause the game controller to simulate one or more subsequent spins of the multicolored wheel to further advance the animated character on the multicolored path if there is at least one spin of the number of spins remaining.

22. The method of claim 1, wherein a second stop position of the plurality of stop positions of the multicolored wheel includes a numerical multiplier and a second color, the method further comprising:

simulating, by the game controller, a subsequent spin of the multicolored wheel that includes a simulated spinning and stopping of the multicolored wheel with the pointer pointing to the second stop position that includes the numerical multiplier and the second color; and advancing, by the game controller and in response to a subsequent simulated spin of the multicolored wheel, the animated character on the multicolored path from the second location to a third location on the multicolored path, wherein the third location is a location on the multicolored path having a color that matches the second color of the second stop position, and wherein the third location also bypasses a number of colored locations on the multicolored path corresponding to the numerical multiplier that match the second color of the second stop position.

23. The method of claim 1, wherein the bonus award symbols further comprise a feature trigger symbol, wherein when the feature trigger symbol is displayed on the multicolor path, the animated character stopping at or passing the feature trigger symbol indicates the triggering of an additional gameplay feature, and said method further comprising:

determining, by the game controller, one of: i) that the bonus award symbol of the second location includes the feature trigger symbol or ii) that the animated character passed a location on the multicolored path having a bonus award symbol that includes the feature trigger symbol when the animated character was advanced to the second location;

initiating, by the game controller and in response to the determining regarding the feature trigger symbol, a different bonus game; and returning, by the game controller, gameplay to the bonus game after the different bonus game is complete.

24. The electronic gaming system of claim 6, wherein the instructions further cause the game controller to generate a bonus award each time the animated character is advanced to a colored location of the multicolored path.

25. The electronic gaming system of claim 6, wherein at least one colored location of the multicolored path is associated with a credit multiplier, and wherein the instructions further cause the game controller to generate a multiplied bonus award based upon the credit multiplier when the animated character is advanced to the at least one colored location of the multicolored path.

* * * * *